US010633876B2

(12) United States Patent
Liggins

(10) Patent No.: US 10,633,876 B2
(45) Date of Patent: Apr. 28, 2020

(54) FURLING CRANE LOADING PLATFORM

(71) Applicant: TRUE POWER PTY LTD, Bondi (AU)

(72) Inventor: Andrew Liggins, Bondi (AU)

(73) Assignee: TRUE POWER PTY LTD, Bondi (AU)

( * ) Notice: Subject to any disclaimer, the term of this patent is extended or adjusted under 35 U.S.C. 154(b) by 126 days.

(21) Appl. No.: 15/771,349

(22) PCT Filed: Oct. 18, 2016

(86) PCT No.: PCT/AU2016/050978

§ 371 (c)(1),
(2) Date: Apr. 26, 2018

(87) PCT Pub. No.: WO2017/079786

PCT Pub. Date: May 18, 2017

(65) Prior Publication Data

US 2018/0305940 A1 Oct. 25, 2018

(30) Foreign Application Priority Data

Nov. 12, 2015 (AU) ..... 2015904680

(51) Int. Cl.
*E04G 3/18* (2006.01)
*E04G 21/16* (2006.01)

(52) U.S. Cl.
CPC ..... *E04G 21/166* (2013.01); *E04G 3/18* (2013.01)

(58) Field of Classification Search
CPC ..... E04G 21/166; E04G 3/18
(Continued)

(56) References Cited

U.S. PATENT DOCUMENTS 1,070,009 A 8/1913 Brown
4,444,289 A * 4/1984 Jungman ..... E04G 21/166 182/36

(Continued)

FOREIGN PATENT DOCUMENTS

ES 2160001 A1 10/2001
WO 1996023943 A1 8/1996

(Continued)

OTHER PUBLICATIONS

International Search Report & Written Opinion dated Nov. 14, 2016 from PCT Application No. PCT/AU2016/050978.

*Primary Examiner* — Alvin C Chin-Shue
(74) *Attorney, Agent, or Firm* — Innovation Capital Law Group, LLP; Vic Lin

(57) ABSTRACT

A furling crane loading platform (1) comprising: a cantilever support base (3); a first stage (2A) pivotally coupled to the cantilever support base (3); and a second stage (2B) pivotally coupled to first stage (2A). In an unfurled configuration (2B) the first and second stages provide a substantially horizontal crane loading surface extending from a building edge (11). The platform is configurable into furled configuration (2A). The platform may further comprise a third stage pivotally coupled to the second stage, fourth pivotally coupled to the third stage, hydraulic actuators (16), controller for controlling the stages in a sequence, sensor for sensing the configuration of the stages, detachable cantilever support beams (4) with a downward transition portion (19), props (5) to prop the cantilever support beams against an under surface of a floor slab and lockout mechanism (17).

29 Claims, 20 Drawing Sheets

(58) Field of Classification Search
USPC ..... 182/223
See application file for complete search history.

(56) References Cited

U.S. PATENT DOCUMENTS

| | | | | |
|---|---|---|---|---|
| 5,595,470 | A * | 1/1997 | Berkey | A61G 3/063 182/144 |
| 7,721,850 | B2 * | 5/2010 | Coble | B66B 9/0853 187/200 |
| 8,522,922 | B1 * | 9/2013 | Stokes | E04G 3/22 114/353 |
| 2009/0020362 | A1 * | 1/2009 | Diaz | E04G 21/166 182/113 |
| 2011/0127111 | A1 * | 6/2011 | Bennett | E06C 5/02 182/113 |
| 2015/0152656 | A1 * | 6/2015 | Mckeon | E04G 21/166 414/800 |
| 2016/0138338 | A1 * | 5/2016 | Olson | E06O 1/39 182/113 |

FOREIGN PATENT DOCUMENTS

| | | | |
|---|---|---|---|
| WO | 2003087500 | A1 | 10/2003 |
| WO | 2011072328 | A1 | 6/2011 |

* cited by examiner

FURLING CRANE LOADING PLATFORM

FIELD OF THE INVENTION

The present invention relates to crane loading platforms and in particular, but not necessarily entirely, to a furling crane loading platform.

BACKGROUND OF THE INVENTION

FIG. 1 shows a prior art suspendable container as per laid open patent publication WO01996023943A1 (hereafter "D1").

D1 discloses a suspendable container comprising a container body (7), anchorage means (19) carried by the body (7) and being movable from a transport position wherein said anchorage means is retracted to an in-use position wherein said anchorage means protrude from the container body, and releasable means, such as pin (37) to lock said anchorage means in the in-use position; the anchorage means (19) when in the in-use position, being able to be affixed to an exposed intermediate floor of a building and thereafter fixedly secure said container body relative to that floor. The anchorage means (19) comprising two frames each of which is pivotally connected to the body (7). Each frame having one or more props (26) vertically extendable when said frames are in the in-use position.

The present invention seeks to provide a furling crane loading platform, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

According to one aspect, there is provided a furling crane loading platform comprising: a cantilever support base; a first stage pivotally coupled to the cantilever support base; and a second stage pivotally coupled to first stage and wherein the platform is configurable in: an unfurled configuration wherein, in use, the first and second stages provide a substantially horizontal crane loading surface extending from a building edge and wherein, when transitioning to the unfurled configuration with the cantilever support base affixed at the building edge the first stage pivots with respect to the cantilever support base in a first rotational direction and wherein the second stage further pivots with respect to the first stage in the first rotational direction; and a furled configuration wherein, when transitioning to the furled configuration with the cantilever support base affixed at the building edge, the second stage pivots with respect to the first stage in a second rotational direction opposite to the first rotational direction, and wherein the first stage further pivots with respect to the cantilever support base in the second rotational direction.

In the furled configuration, the first and second stages may be substantially orthogonal with respect to each other.

In the furled configuration, the first stage may be approximately 45° with respect to the cantilever support base.

In use, the platform may be configured such that, in the furled configuration, at least a portion of the furled stages may be within the building edge.

The platform may further comprise a third stage pivotally coupled to the second stage.

The platform may further comprise a fourth stage pivotally coupled to the third stage.

In the furled configuration, the stages assume a substantially rectangular configuration.

The platform may further comprise actuators for acting on the stages.

The actuators comprise hydraulic actuators.

The platform may further comprise a controller for controlling the actuators.

The controller may be configured for controlling the stages in a sequence.

The sequence may comprise a furling sequence wherein the controller controls the second stage to pivot with respect to the first stage in the second rotational direction whereafter the controller controls the first stage to pivot with respect to the cantilever support base in the second rotational direction.

The controller pivots the second stage until such time that the second stage may be substantially orthogonal with respect to the first stage.

The sequence may comprise an unfurling sequence wherein the controller controls the first stage to pivot with respect to the cantilever support base in the first rotational direction whereafter the controller controls the second stage to pivot with respect to the first stage in the second rotational direction.

The controller may be configured for sensing the configuration of the stages.

The platform may further comprise at least one sensor operably coupled to the controller The at least one sensor may comprise at least one of rotational sensing and position limit switch sensors.

The cantilever support base may comprise parallel cantilever support beams.

The platform may further comprise support props to prop the cantilever support beams against an undersurface of a floor slab above.

The platform may further comprise transverse braces between the cantilever support beams.

The transverse braces may be removable from the cantilever support beams.

The cantilever support beams may be detachable.

The cantilever support base may comprise a downward transition for location beyond the building edge and wherein the stages may be connected to the downward transition such that the crane loading surface may be substantially level with a surface of a floor slab.

The downward transitioning portion may comprise support bases and wherein the first stage may comprise laterally projecting feet and wherein, in the unfurled configuration, the feet may be supported by the support base.

The platform may further comprise crane lift lugs.

The platform may further comprise two pairs of laterally adjacent and opposite crane lift lugs to support the platform both longitudinally and laterally during lifting in use.

The platform may further comprise a pivot between the first and second stages and further comprising abutments adjacent the pivot and wherein, the abutments abut against each other in the unfurled configuration.

The platform may further comprise lockout mechanisms to lock the platform in the unfurled configuration.

The first and second stages each may comprise lateral barrier panels and wherein the barrier panels of each respective lateral side of the first and second stages are laterally offset to allow the adjacent barrier panels to slide past each other as the first stage pivots with respect to the second stage.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
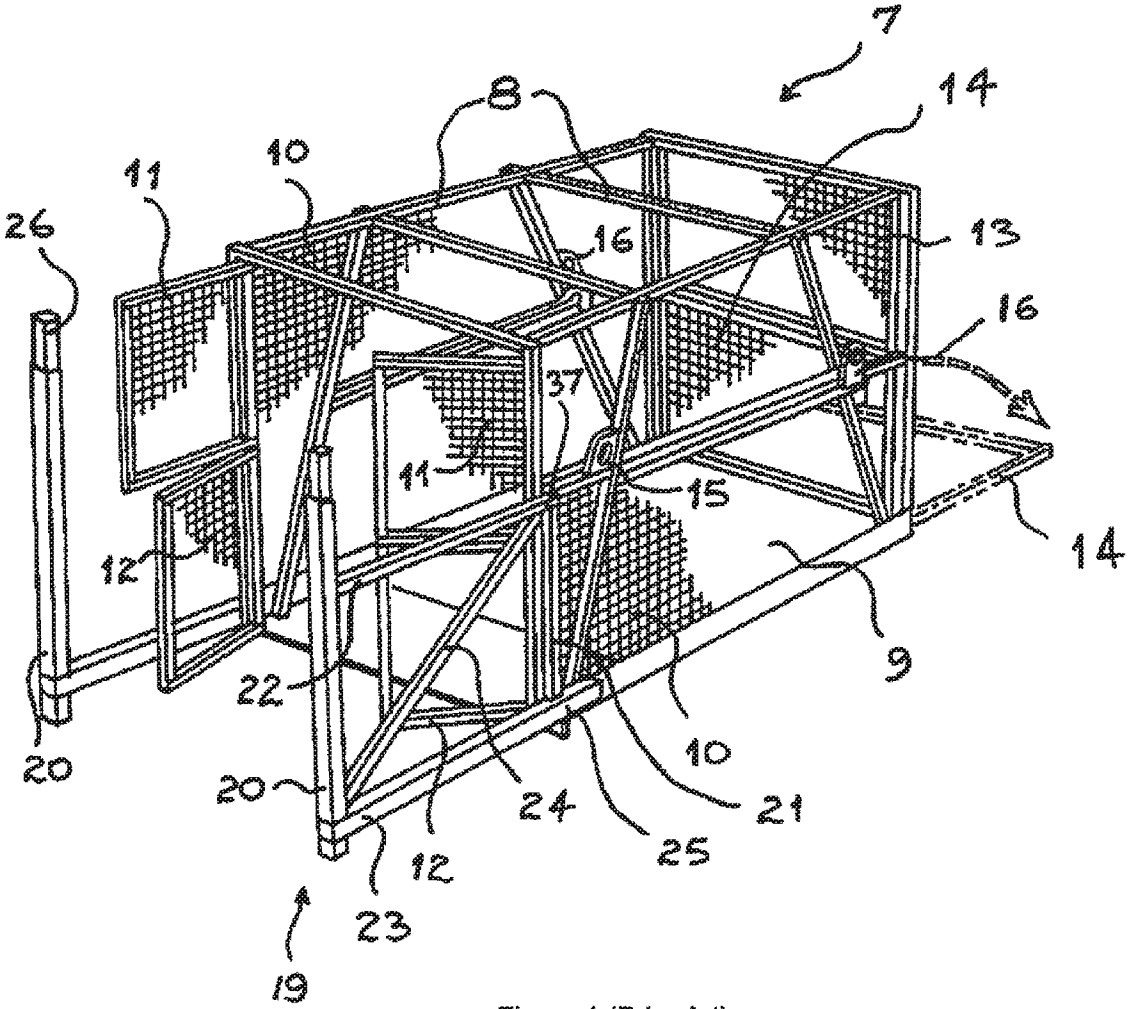
Figure 1 (Prior Art)
FIG. 1 shows a crane loading platform of the prior art.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

Before the structures, systems and associated methods relating to the furling crane loading platform are disclosed and described, it is to be understood that this disclosure is not limited to the particular configurations, process steps, and materials disclosed herein as such may vary somewhat. It is also to be understood that the terminology employed herein is used for the purpose of describing particular embodiments only and is not intended to be limiting since the scope of the disclosure will be limited only by the claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterised by," and grammatical equivalents thereof are inclusive or open-ended terms that do not exclude additional, unrecited elements or method steps.

It should be noted in the following description that like or the same reference numerals in different embodiments denote the same or similar features.

In the embodiments that follow, there is provided a furling crane loading platform 1. As will become apparent from the ensuing description, the platform 1 comprises a plurality of stages 2 pivotally coupled together such that the platform 1 is able to transition between unfurled and furled configurations.

Specifically, the platform 1 is configured for cantilevering from a building edge during building construction. When in the unfurled configuration, the stages 2 extend from the edge of the building to provide a substantially horizontal crane loading surface for loading of construction goods and the like. When not in use, or for transportation or the like, the platform is configurable in the furled configuration wherein the stages 2 are furled or rolled up such that the platform 1 takes a more compact configuration as compared to when in the unfurled configuration. In embodiments, the stages 2 assume a substantially rectangular box like configuration as is shown in the illustrations.

As such, the platform 1 may be furled when not in use, for installation and removal, transportation and the like.

Figure 2:
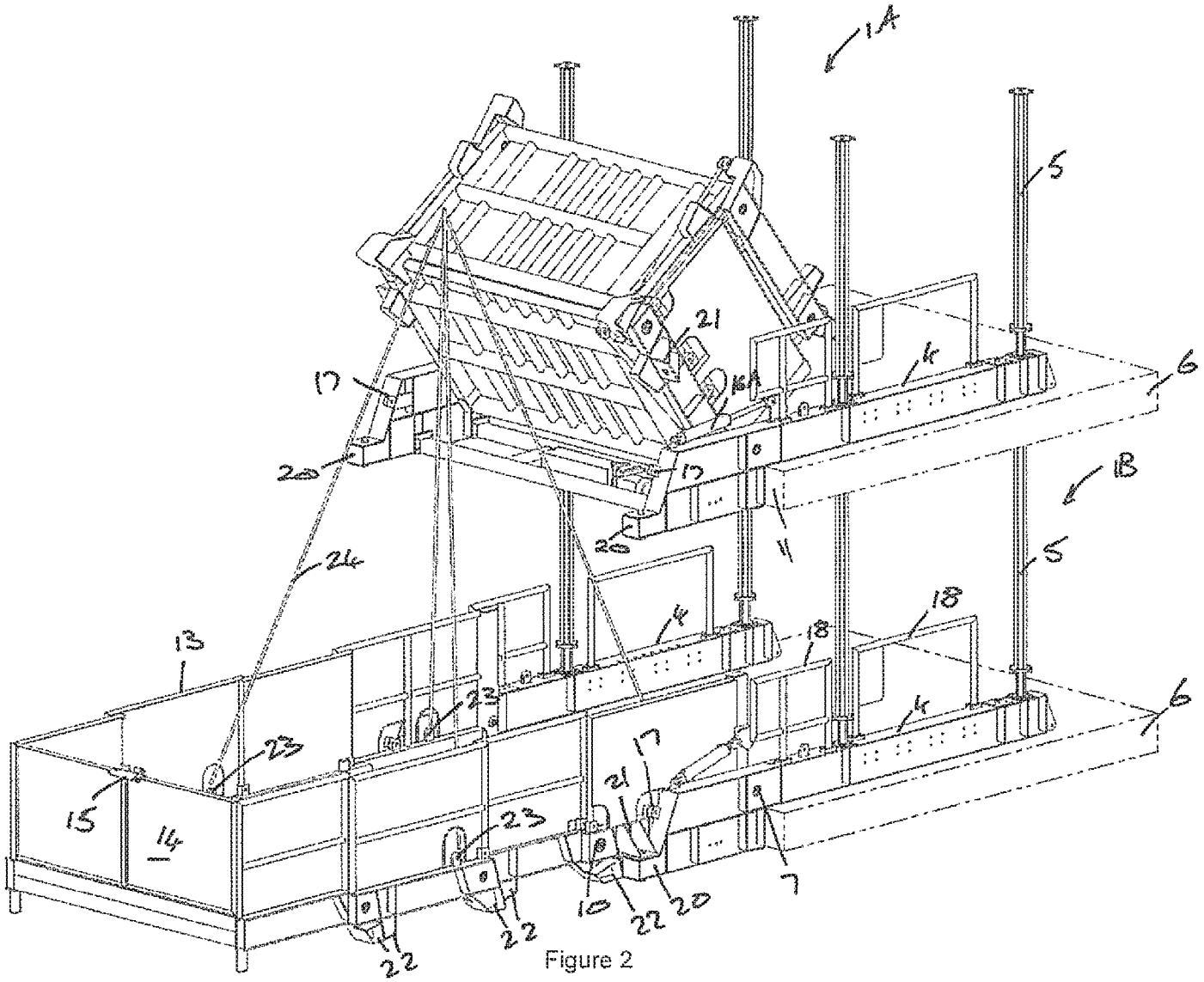
FIG. 2 shows a perspective view of a furling crane loading platform in both furled and unfurled configurations in accordance with an embodiment of the present disclosure.
Figure 3:
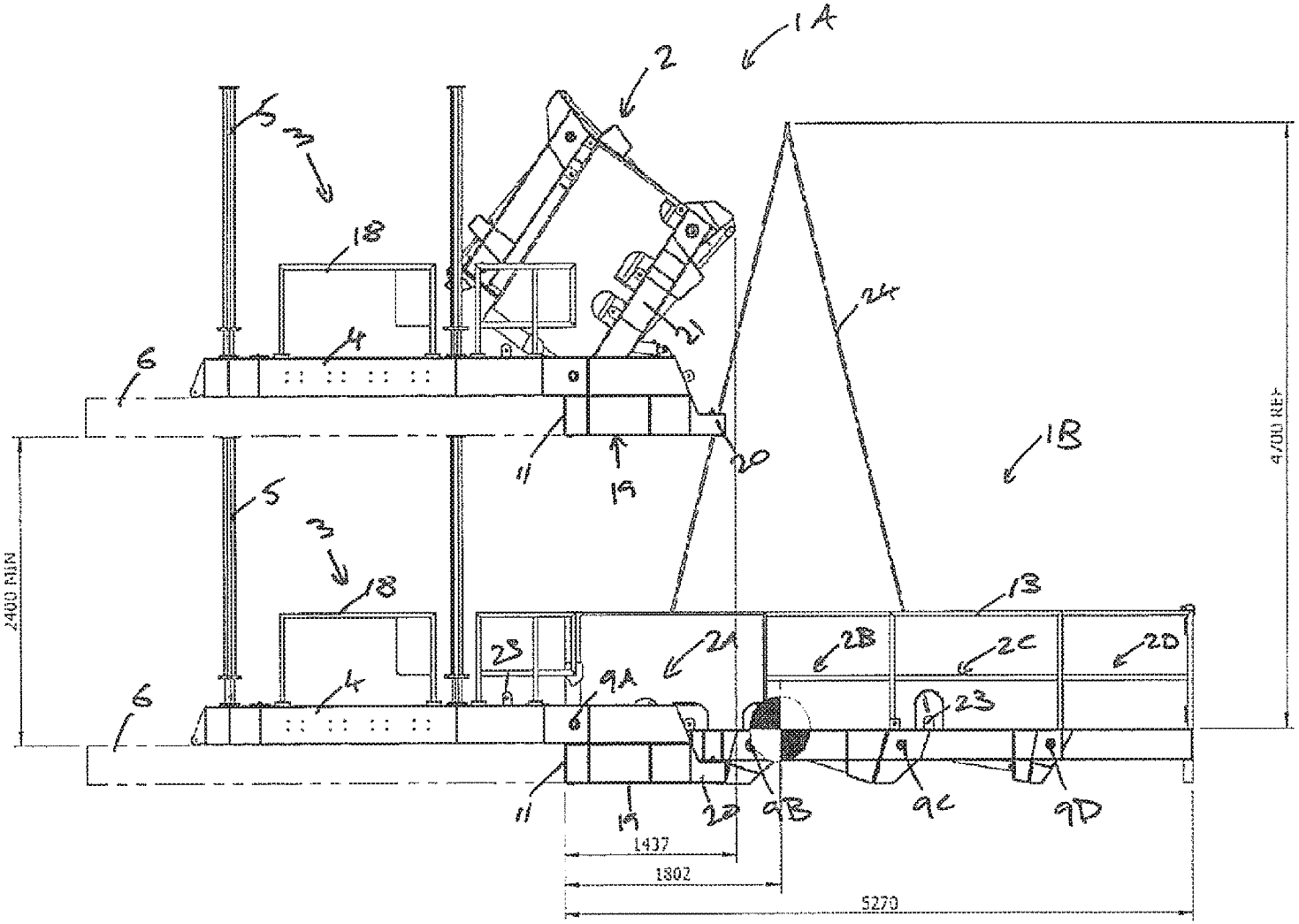
FIG. 3 shows a side elevation view of the furling crane loading platform in accordance with an embodiment of the present disclosure.

Specifically, turning to FIG. 2, there is shown a perspective view of the platform 1 showing the platform in the furled configuration 1A and in the unfurled configuration 1B. Similarly, FIG. 3 shows a side elevation views of these configurations.

Figure 4:
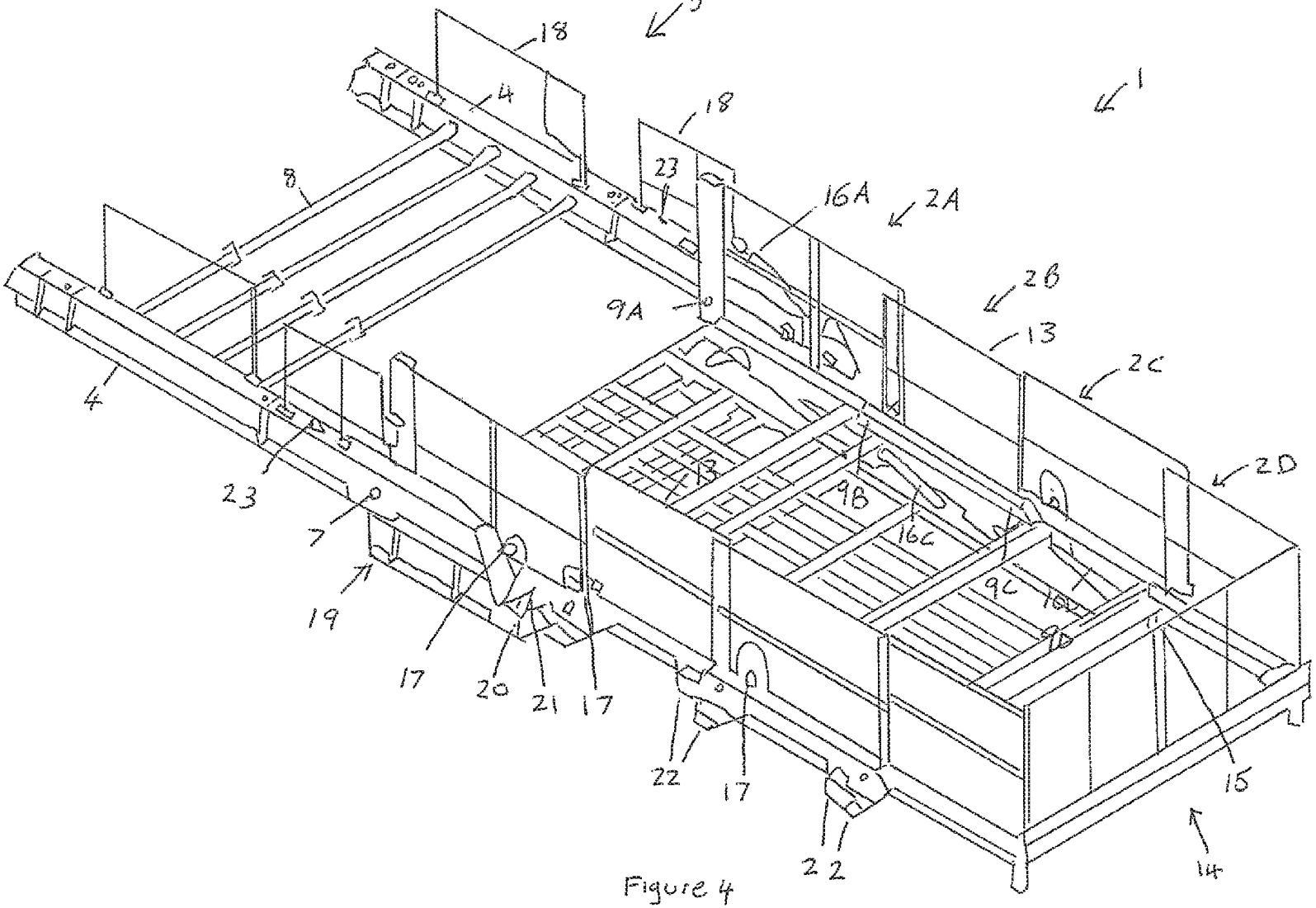
FIG. 4 shows a top perspective view of the furling crane loading platform in the unfurled configuration in accordance with an embodiment of the present disclosure.
Figure 5:
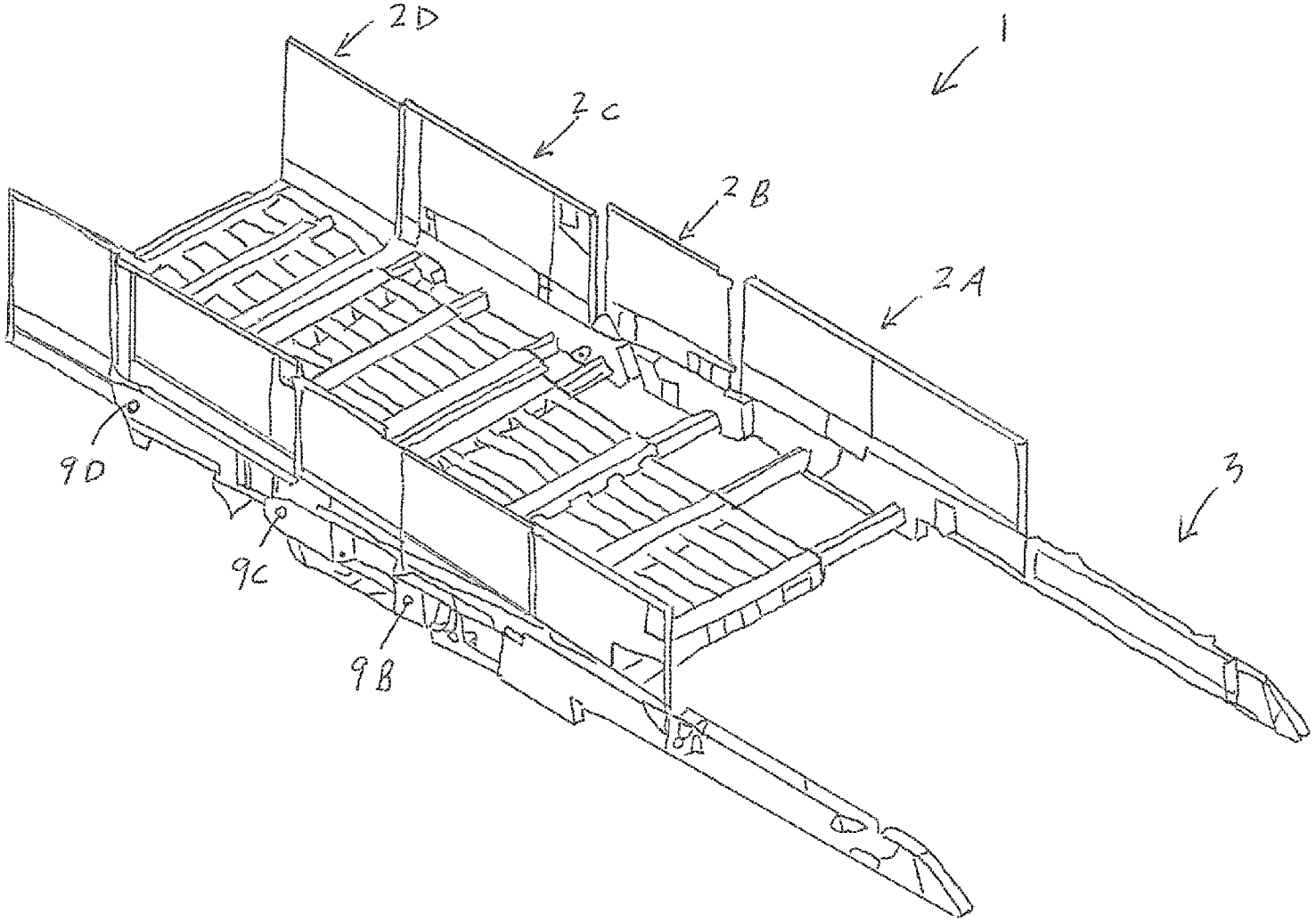
FIG. 5-13 show perspective views of the furling action of the furling crane loading platform in accordance with an embodiment of the present disclosure.

Turning now to FIG. 4, there is shown the platform 1 in further detail in the unfurled configurations 1B. As can be seen, the platform 1 comprises a plurality of stages 2 wherein, in the embodiment shown, the platform 1 comprises four stages numbered sequentially from 2A-2D. It should be noted that in other embodiments, more or less stages may be utilised wherein, for example, certain embodiments, the platform 1 may comprise three stages 2.

The stages 2 are supported by a cantilever support base 3 to be able to project from a building edge in use. Specifically, the cantilever support base 3 engages the building to cantilever the stages 2 beyond the building edge for loading purposes. In the embodiments described herein, the term "support base" should be construed broadly as any mechanism or arrangement which facilitates the fastening or support of the platform 1 such that the platform 1 can extend out from a building edge.

In the embodiment shown, the cantilever support base 3 comprises a pair of parallel cantilever support beams 4. In this embodiment, and turning to FIG. 2, the cantilever support beams 4 may be held in place by vertical support props 5 which engage the undersurface of the slab 6 above.

In embodiments, and especially for transportation purposes, the cantilever support beams 4 may be removable, such as by way of removable connecting pins 7. As such, in the furled configuration, with the support beams 4 detached, the furled stages 2, which may take the form of a rectangular, boxlike configuration, may comprise a longitudinal length of approximately between 1.5 and 2 m. In this manner, the stages 2 may be conveniently stored within a standardised shipping container. Specifically, in embodiments, three furled platforms 1 may be stored within a single conventional shipping container.

The cantilever support beams 4 may be further supported by transverse braces 8 which may themselves similarly be removable from the support beams 4 for stowage and transportation purposes.

Now, in describing the operation of the platform, as can be seen from FIG. 4, the first stage 2A is pivotally coupled to the cantilever support base 3 such as by way of pivot point 9A. Furthermore, the second stage 2B is pivotally coupled to the first stage 2A, again similarly by way of pivot point 9B. Similarly, the further stages 2C-2D themselves pivotally coupled in sequence in the same manner by way of pivot points 9C-9D.

As such, in the unfurled configuration 1B, the stages 2 provide a substantially horizontal crane loading surface extending from a building edge 11. As such, the crane loading surface can be utilised for loading of various building goods by crane.

Now, when transitioning to the unfurled configuration 1B with the support base being fixed to the slab 6 the first stage 2A pivots with respect to the cantilever support base 3 in a first rotational direction and wherein the second stage 2B further pivots with respect to the first stage 1A in the same first rotational direction. Similarly, the remainder stages 2 would also pivot with respect to the previously adjacent stage in the same first direction. Specifically, referring to FIGS. 3 and 4, the first rotational direction would be clockwise given the orientation of the figures.

Now, in transitioning to the furled configuration, the stages 2 rotate in the opposite direction as described above. Specifically, with the support base 3 affixed to the slab 6 the second stage 2B pivots with respect to the first stage 1A in a second rotational direction wherein the second rotational direction is opposite to the first rotational direction. Specifically, referring again to FIGS. 3 and 4, the second rotational direction would be counterclockwise given the orientation of the illustrations given. Furthermore, the first stage 1A further pivots with respect to the cantilever support base 3 in the same second rotational direction. Similarly, the other stages 2C-D would also rotate in the same second rotational direction.

In embodiments, when in the furled configuration, each stage 2 is substantially orthogonal with the adjacent stage 2 such that the furled stages 2 assume a substantially rectangular or boxlike configuration.

Further specifically, as can be seen from FIG. 2, in the furled configuration 2A, at least a portion of the stages 2 may be within the building perimeter as defined by the slab 6 edge 11 to not unnecessarily provide obstruction beyond the building edge. However, it should be appreciated that, in other embodiments, the furled stages 2 may be retracted entirely within the building perimeter or, in alternative embodiments, remain entirely outside the building perimeter when in the furled configuration.

In the particular embodiment shown in FIG. 2, in the furled configuration the first stage 2A is substantially 45° with respect to the support base 3. In this manner, the stages 2, in the furled configuration lie at least partially within the building perimeter.

As can be further seen from FIG. 4, each stage 2 may comprise lateral barrier panels 13 for safety and practical utility purposes. As can also be seen, the panels 13 of adjacent stages 2 may be laterally offset with respect to each other to allow the adjacent barrier panels 13 to slide past each other as each stage 2 pivots with respect to the adjacent stage 2. In embodiments, as opposed to providing barrier panels or barrier mesh, barrier railing may be alternatively applied.

Similarly, safety railing 18 may be provided for the cantilever support base 3.

Furthermore, the platform 1 may comprise an end gate 14 which may take the form of the bifurcated swing gate shown which may be fastened by way of gate latch 15.

In embodiments, the platform 1 may comprise lockout mechanisms 17 to lock the platform 1 in the unfurled configuration 1B.

The cantilever support base 3 may comprise a downward transitioning portion 19 configured to sit beyond the slab 6 edge 11. In this manner, the downward transitioning portion 19 may define a rearward facing edge which abuts against the slab 6 edge 11 to set the position of the platform 1 and, in a preferred embodiment, locate the stages 2 at a lower level to provide for a crane loading surface substantially level with the slab 6 surface thereby avoiding vertical transitions which could hinder the goods loading process.

Furthermore, the downward transition portion 19 may define support bases 20 for supporting laterally projecting feet 21 of the first stage 2A. Similarly, each inter-stage juncture may comprise downwardly projecting abutment reinforcements 22 which abut against each other substantially at or beneath the respective pivot point 9 to limit the pivot extent of each stage juncture and also to support the pivot point 9.

As can be further seen from FIG. 4, the platform 1 may comprise crane loading lugs 23 which may be located within cutouts of the adjacent barrier panels 13 to which crane cables may be fastened during installation and removal.

Specifically, turning to FIG. 2, there is shown crane loading cables 24 being fastened to the respective lugs 23 for lifting the platform 1. In embodiments, the platform 1 may be hoisted in the unfurled configuration 1B during installation and removal. Specifically, when in the unfurled configuration 1B, four crane hoist cables 24 may be fastened to the respective lugs 23 to support the platform 1 at four points, both laterally and longitudinally to allow the hoisting thereof in the unfurled configuration 1 be wherein, for example, for installation, the platform 1 may be hoisted to the relevant building floor to be manoeuvred such that the cantilever beams 4 extend into the building which may then be fastened utilising the support columns 5 wherein, one supported, the crane hoist cabling 24 may be detached. In embodiments, further crane hoist lugs 23 may be located on the cantilever support beams 4 as can be seen from FIG. 4. In alternative embodiments, the platform 1 may be hoisted when furled.

Furthermore, in a preferred embodiment, the platform 1 is mechanically actuated such as by way of hydraulic actuators. As such, the platform 1 may comprise a plurality of hydraulic actuators 16 wherein, as can be seen, the hydraulic actuators 16 comprise a first hydraulic actuator 16A to control the rotation of the first stage 2A with respect to the cantilever support base 3, a second hydraulic actuator 16B to control the rotation of the second stage 2B with respect to the first stage 2A and so on and so forth. In the embodiment shown, the hydraulic actuators 16 are provided only on one side of the platform 1 but, as can be appreciated, in embodiments, hydraulic actuators may be provided on both sides of the platform.

In a particular embodiment, the first hydraulic actuator 16 may be a Nordon™ hydraulic cylinder actuator comprising a 3" bore with a 14" stroke and a 1.5" diameter rod. The second hydraulic actuator 16B may have a 20" stroke, the third hydraulic actuator 16C may have a 2.5" bore and an 18" stroke and a 1.25" diameter rod and the fourth hydraulic actuator 16 may comprise a 2" bore, a 16" stroke and a 1" diameter rod.

In embodiments, the hydraulic actuators 16 may be controlled in sequence to furl and unfurl the platform 1 in the particular manner described hereinbelow with reference to FIGS. 5-19.

In this manner, the platform 1 may comprise a controller device, such as a ruggedised programmable logic controller (PLC) device configured to control the relevant stages 2 in sequence.

In this manner, the controller may expose binary control buttons for respectively furling and unfurling the platform wherein, when either is actuated, the controller controls the relevant hydraulic actuators 16 accordingly.

In embodiments, rotational position sensors, positional limit switches and the like may be provided at the relevant pivot points to allow the controller to ascertain the current configuration of the platform 1 to be able to control the hydraulic actuators 16 appropriately.

Turning now to FIGS. 5-19, there will be described the furling and unfurling sequence of the platform 1 in further detail wherein FIG. 5-13 shows a perspective view of the platform 1 in operation whereas FIGS. 14-19 show a lateral side elevation view of the platform 1 in operation.

Figure 20:
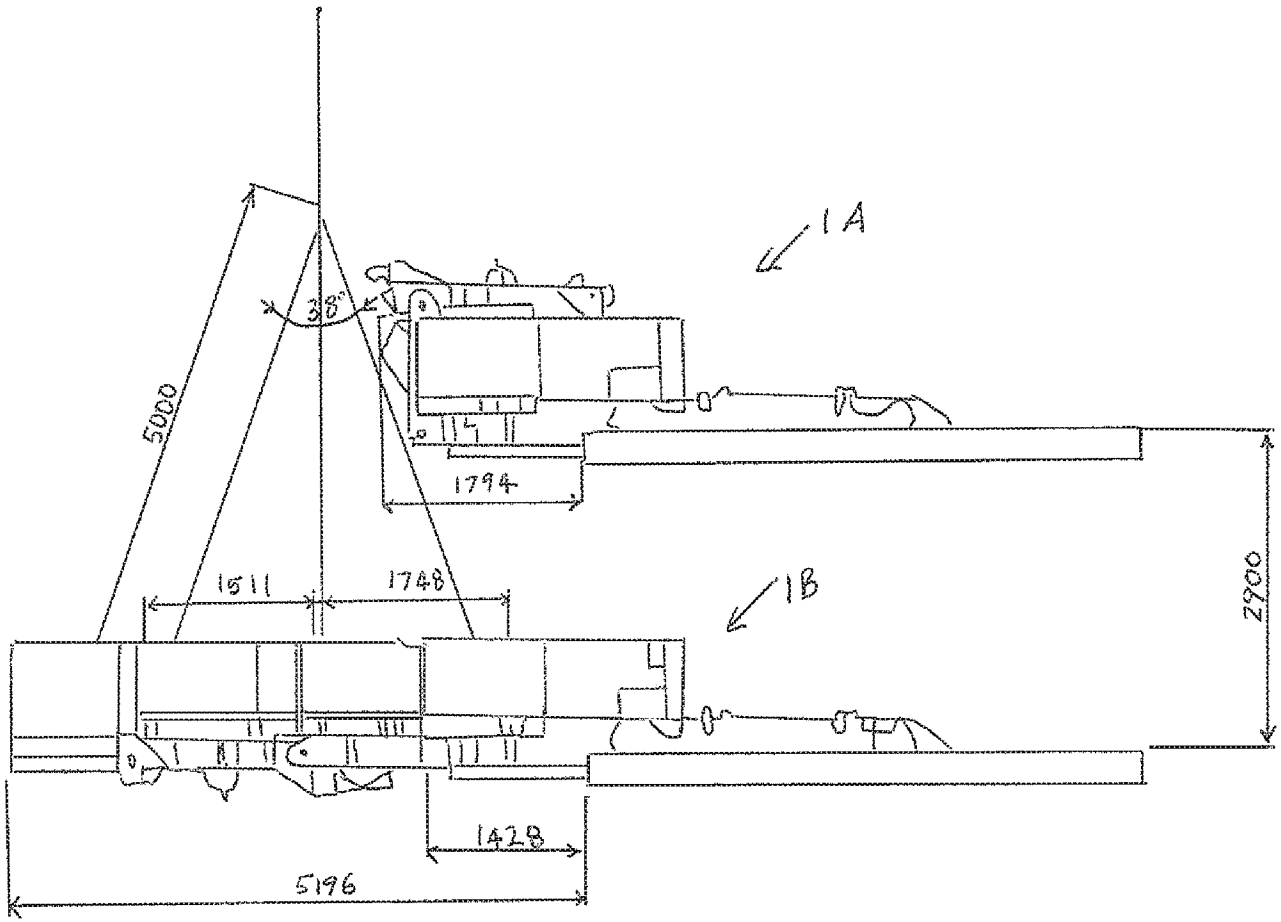
FIG. 20 shows exemplary dimensions of the crane loading platform in accordance with an embodiment of the present disclosure.

Furthermore, for the particular embodiment of the platform 1 shown in FIG. 5-19, exemplary dimensions are provided in FIG. 20.

Specifically, in one embodiments, the first stage 2A may comprise a longitudinal length of approximately 1.8 m, the second stage 2B a longitudinal length of approximately 1.2 m, the third stage 3C a longitudinal length of approximately 1.6 m and the fourth stage 2D a length of approximately 1 m. However, it should be appreciated that variations may be made to the dimensions within the purpose of scope of the embodiments described herein.

Now, considering specifically FIG. 1, there is shown the platform 1 in the unfurled configuration 1B. As can be seen, each stage 2 is laid out substantially horizontally to provide the aforedescribed substantially horizontal crane loading surface. In the embodiments shown, the brace work of each stage 2 is shown but, should be appreciated that, in embodiments, floor panelling may be provided thereupon to complete the floor surface, either permanently or removably affixed.

Figure 6:
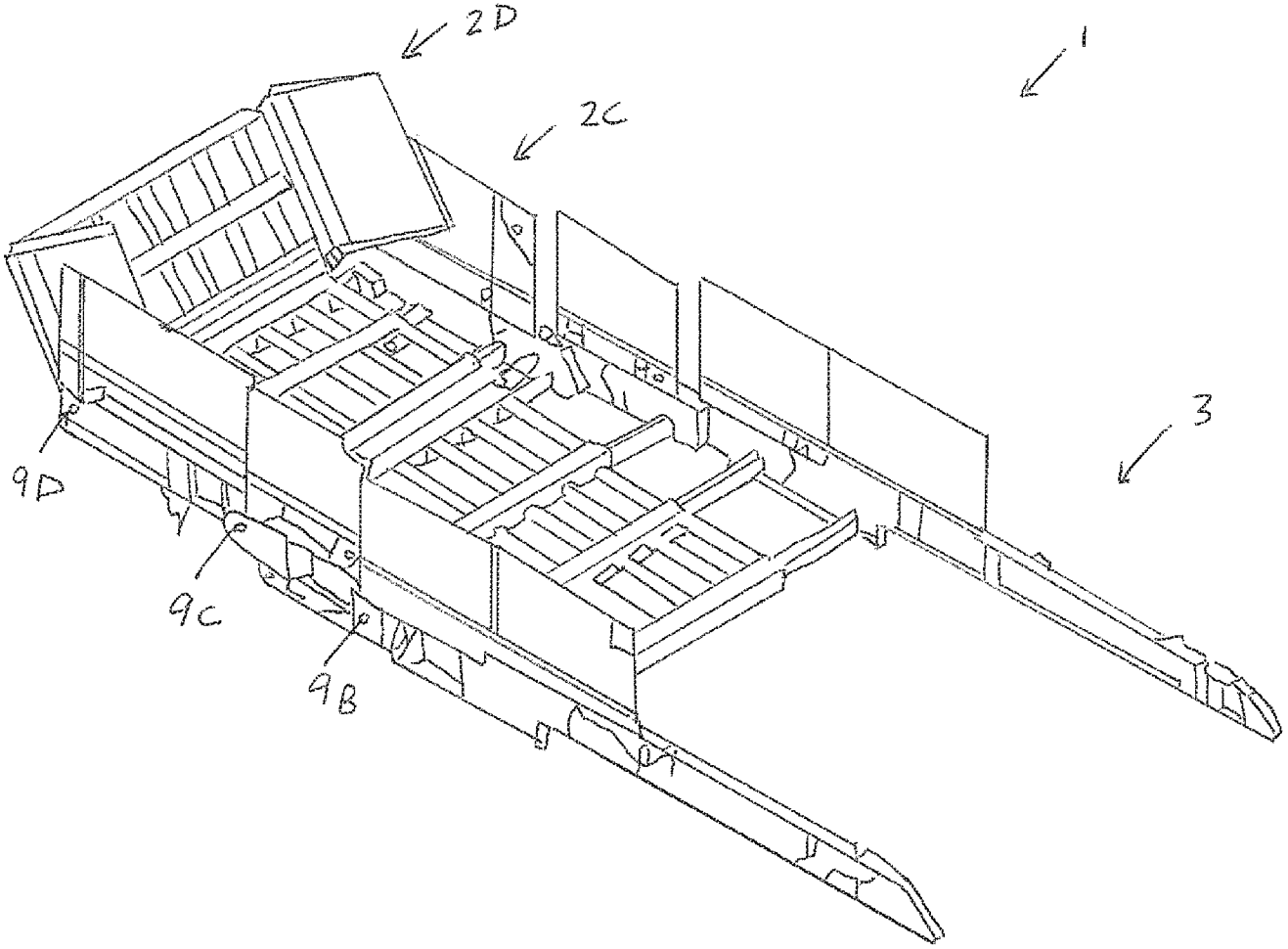
Figure 7:
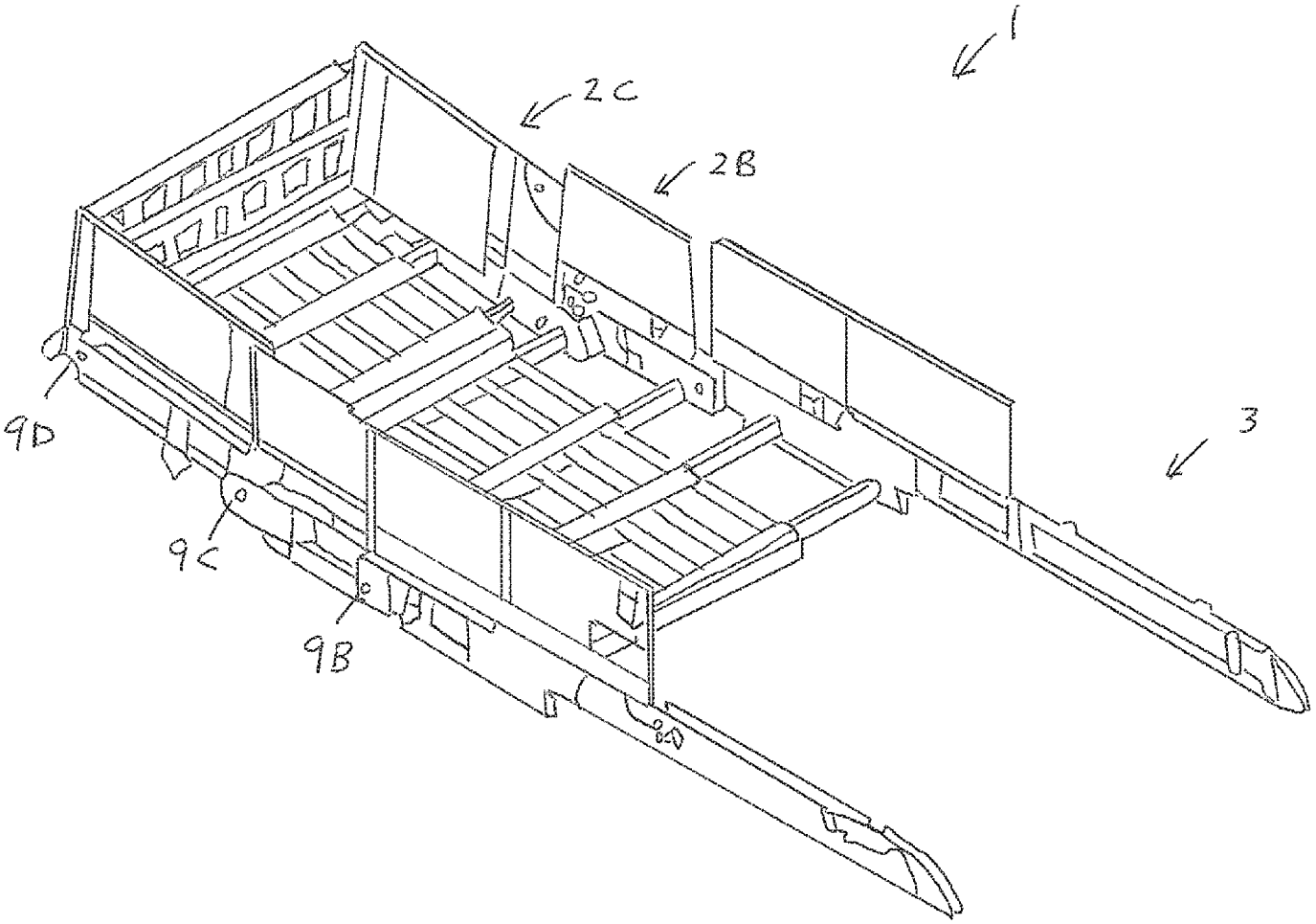

Turning now to FIG. 6, as can be seen, to initiate the furling action, the fourth stage 2D begins to rotate with respect to the third stage 2C. As alluded to above, the operation of the platform 1 described herein may be controlled automatically by the aforedescribed controller. Turning now to FIG. 7, as can be seen, once the fourth stage 2D is substantially orthogonal with respect to the third stage 2C, the third stage 2C begins to rotate with respect to the second stage 2B. As can also be seen, the barrier panelling 13 of adjacent stages 2 is able to slide past each other on account of being laterally offset.

Figure 8:
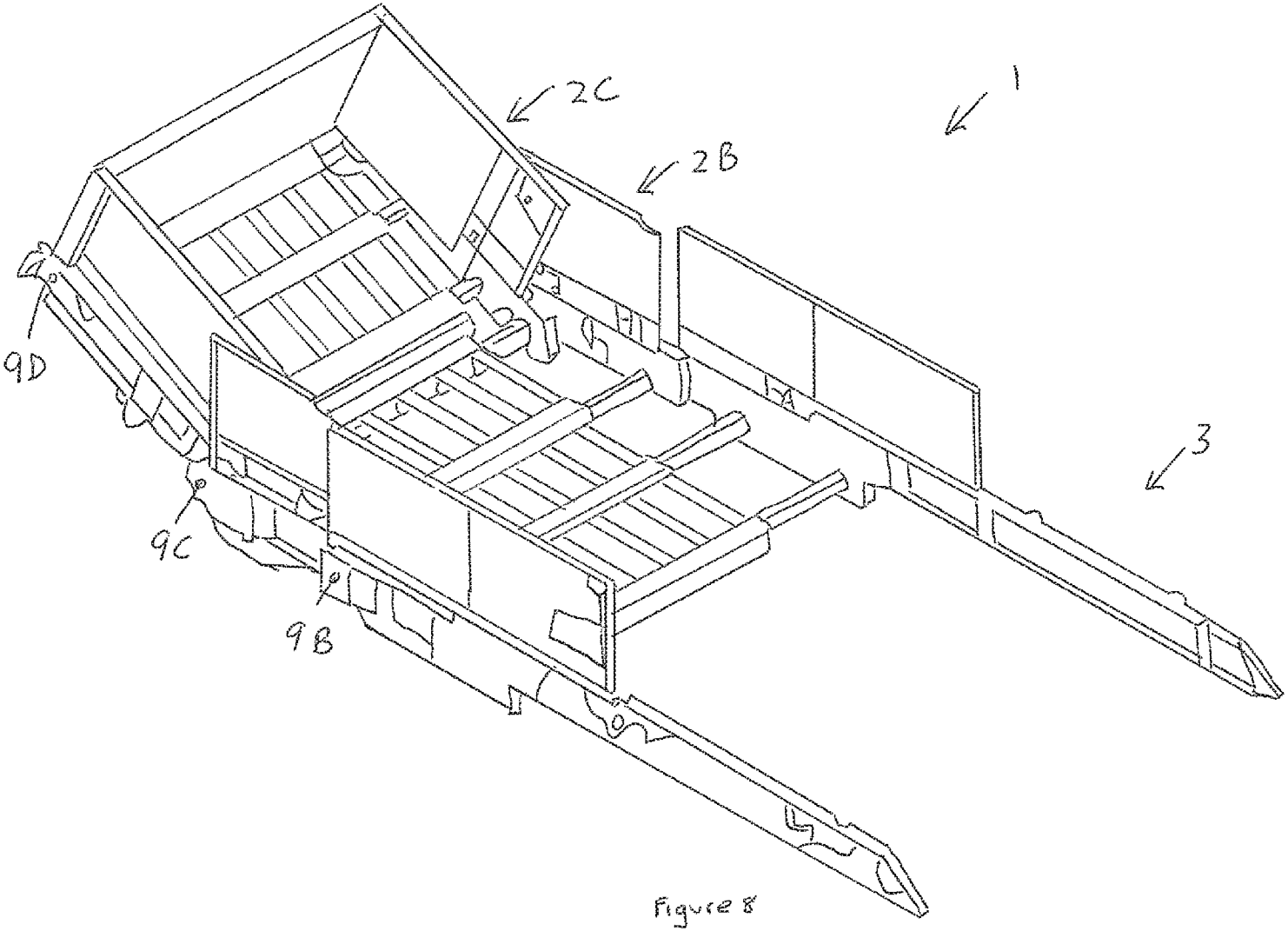
Figure 9:
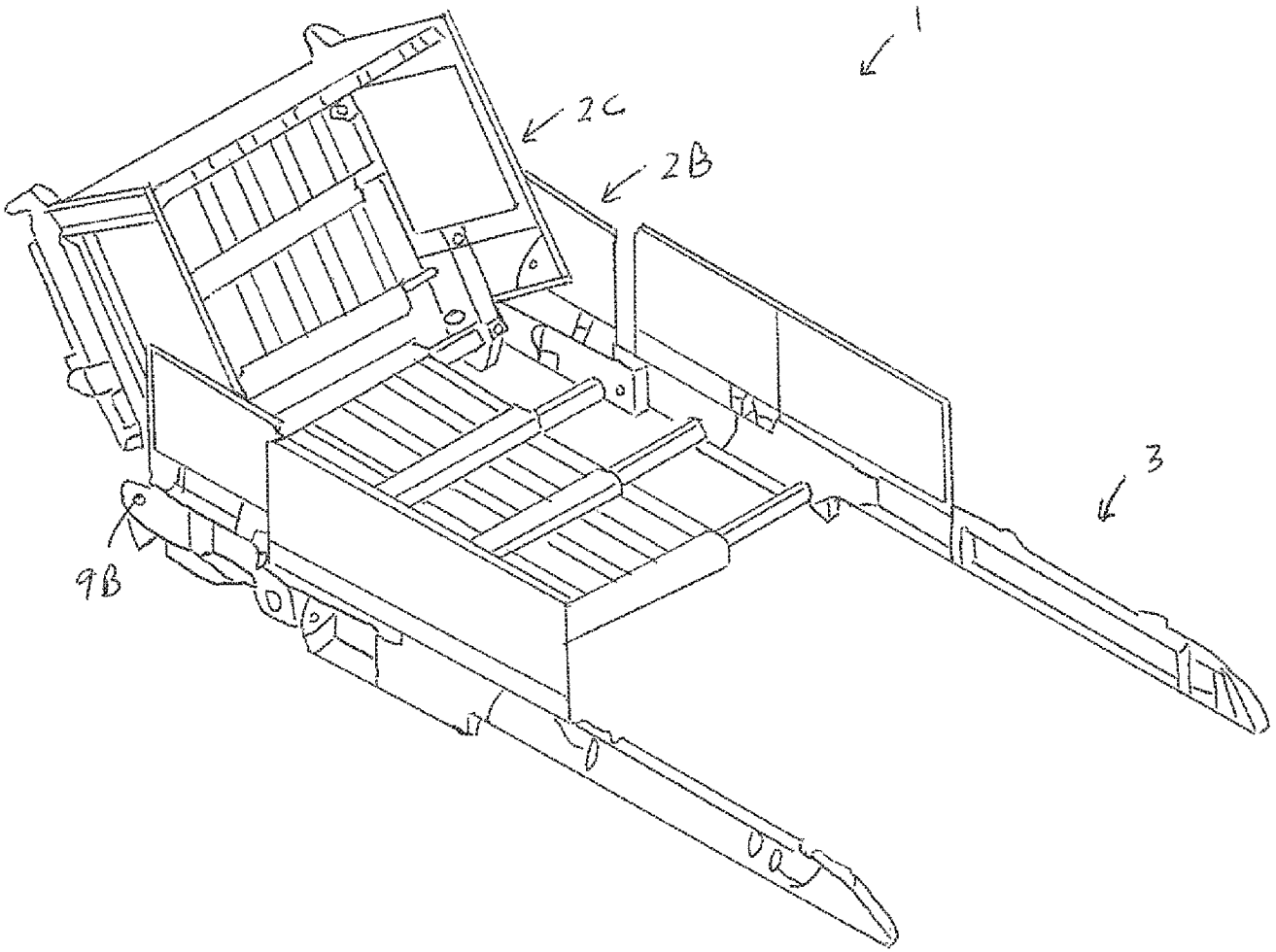
Figure 10:
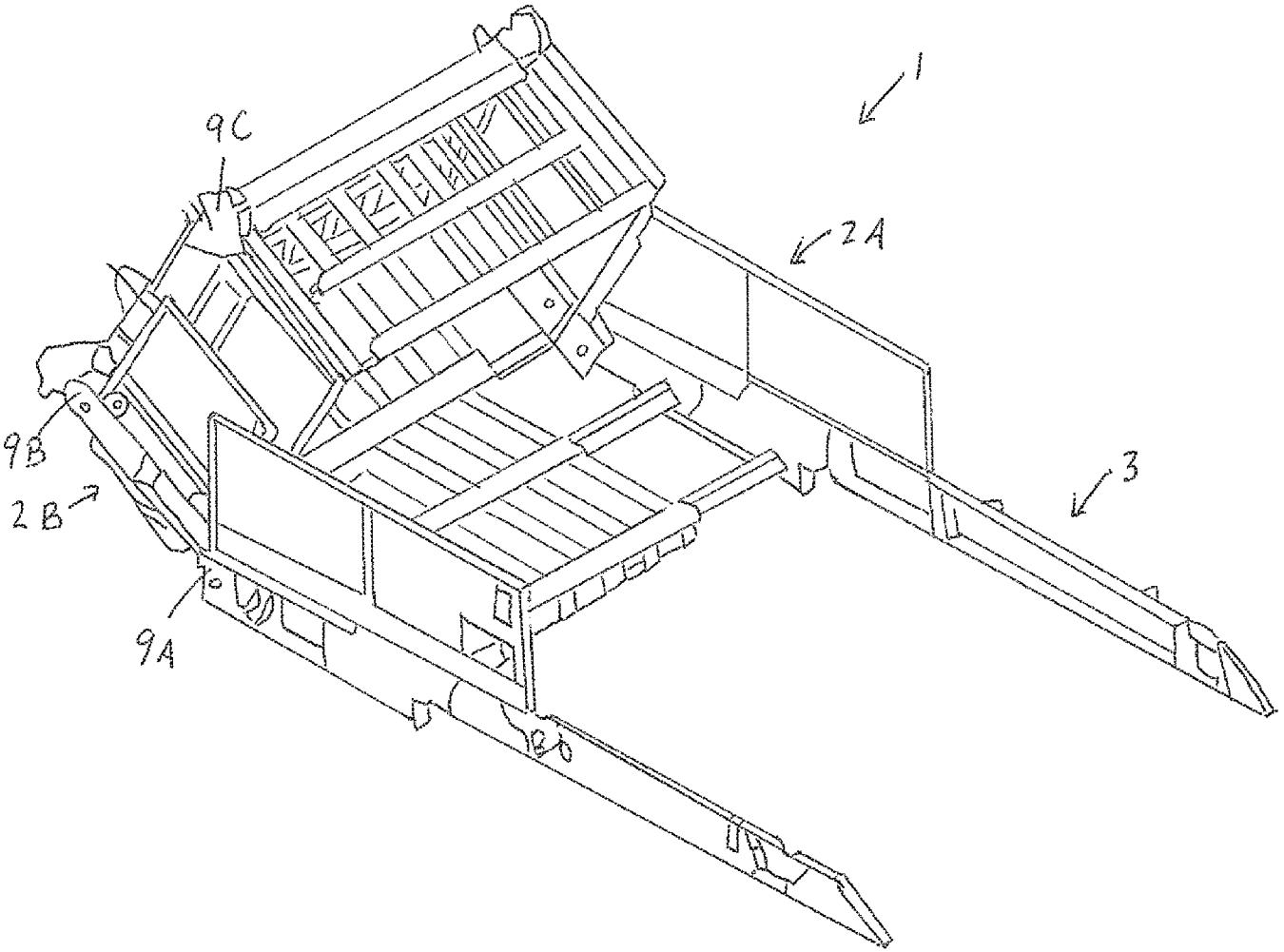
Figure 11:
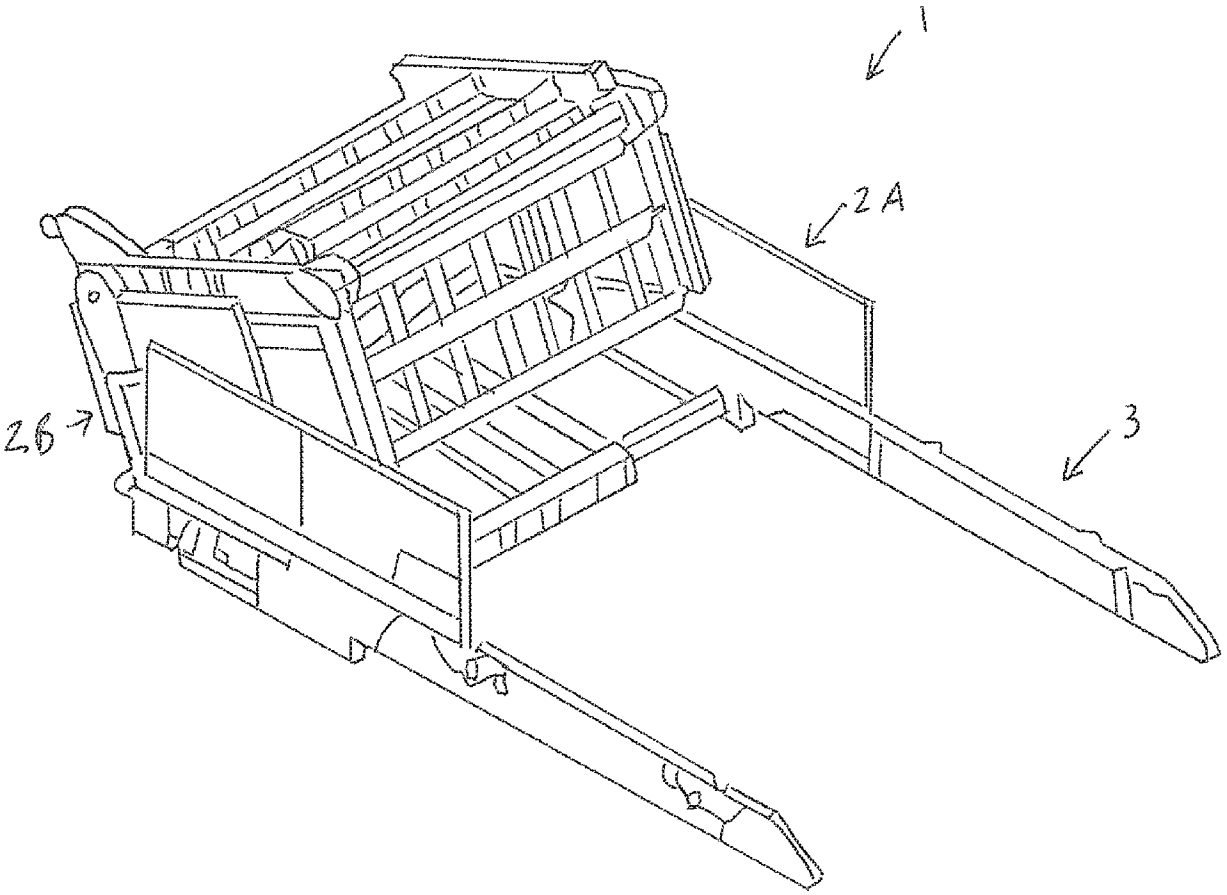

Turning now to FIG. 8, there is shown the third stage 2C further rotating with respect to the second stage 2B, wherein FIGS. 9-11 show the further rotational stages of the second stage 2B with respect to the first stage 2A.

Figure 12:
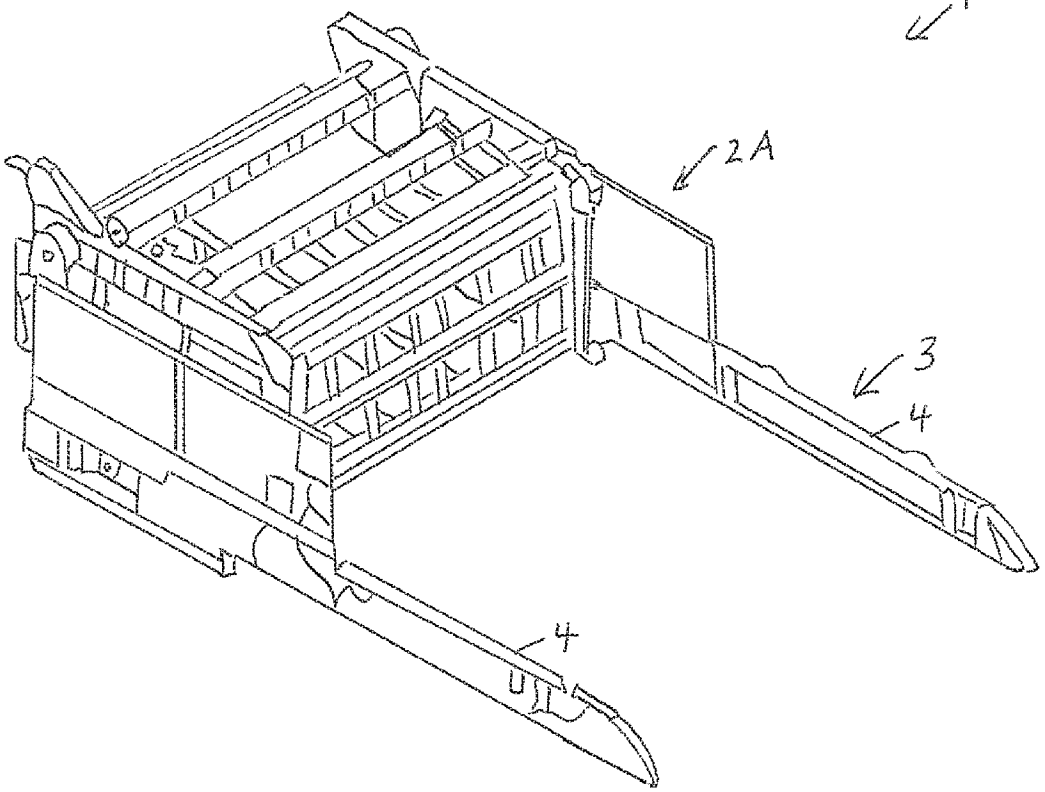

FIG. 12 shows the complete rotation of the second stage 2B with respect to the first stage 2A.

Now, in embodiments, the first stage 2A may be fixed with respect to the cantilever beams 4 such that the platform 1 effectively comprises three sections.

Figure 13:
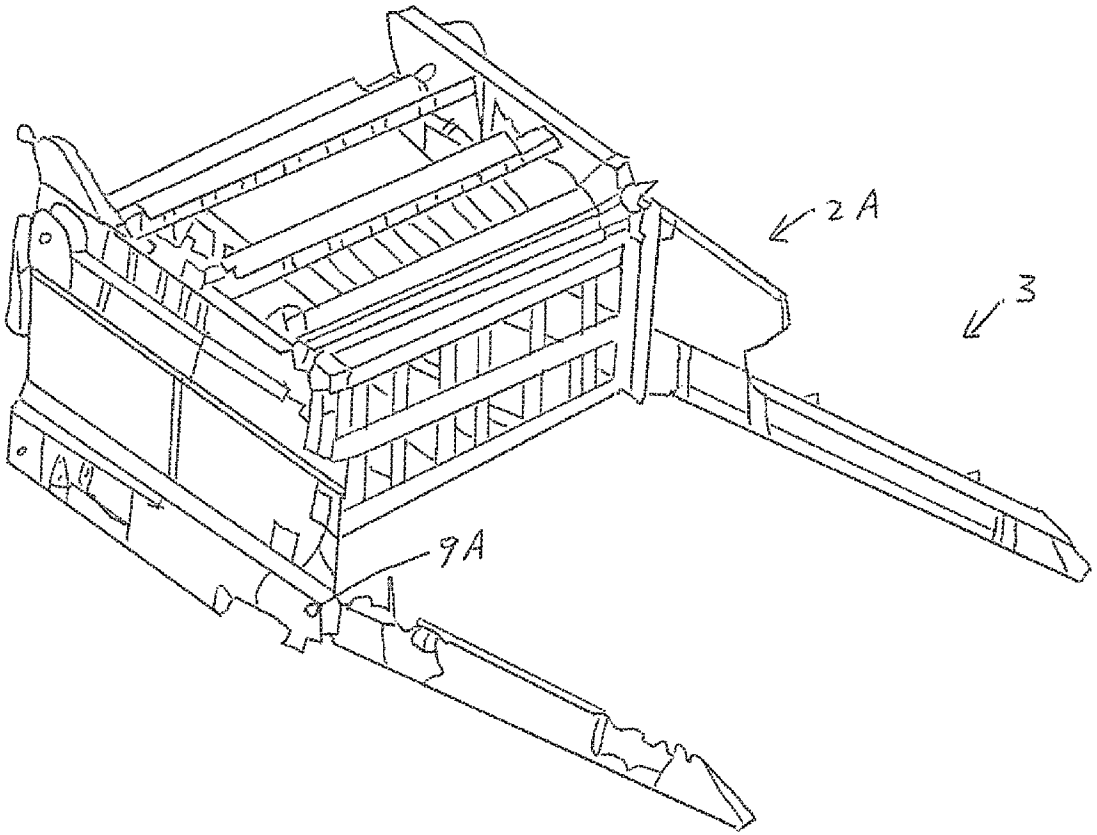
Figure 14:
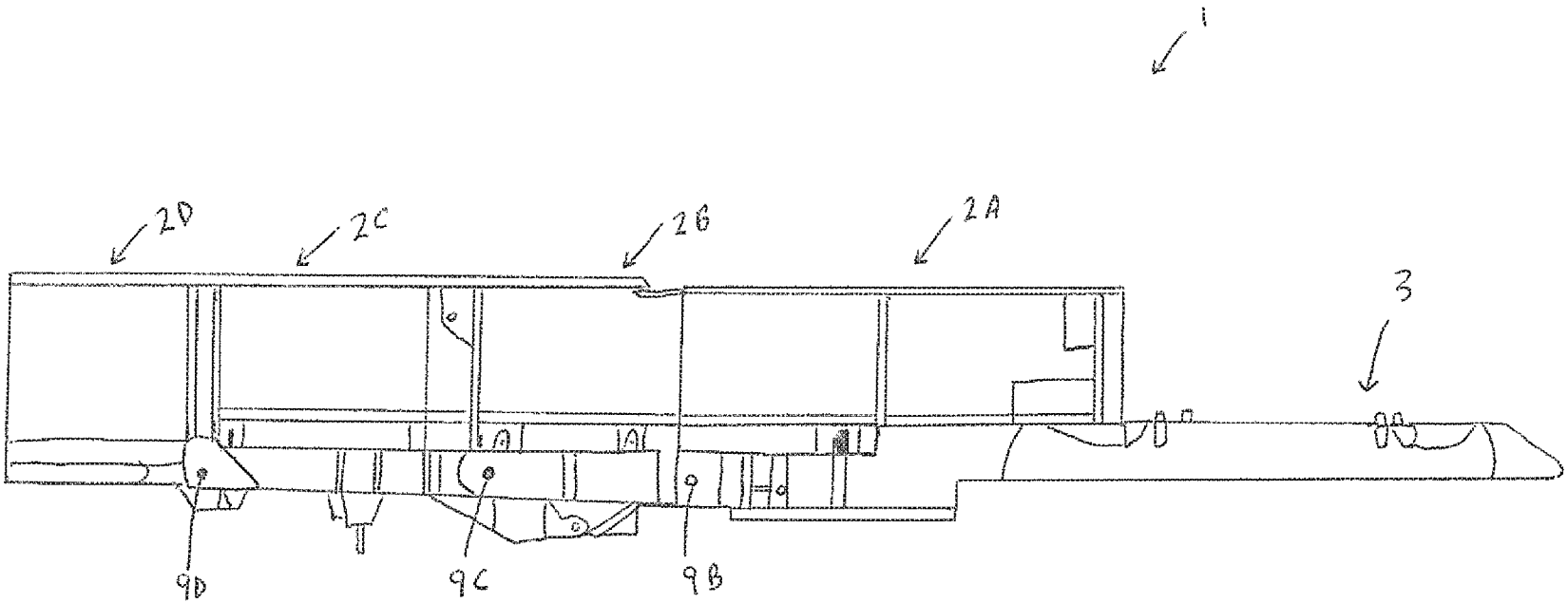
FIG. 14-19 shows side elevation views of the furling action of the furling crane loading platform in accordance with an embodiment of the present disclosure.
Figure 15:
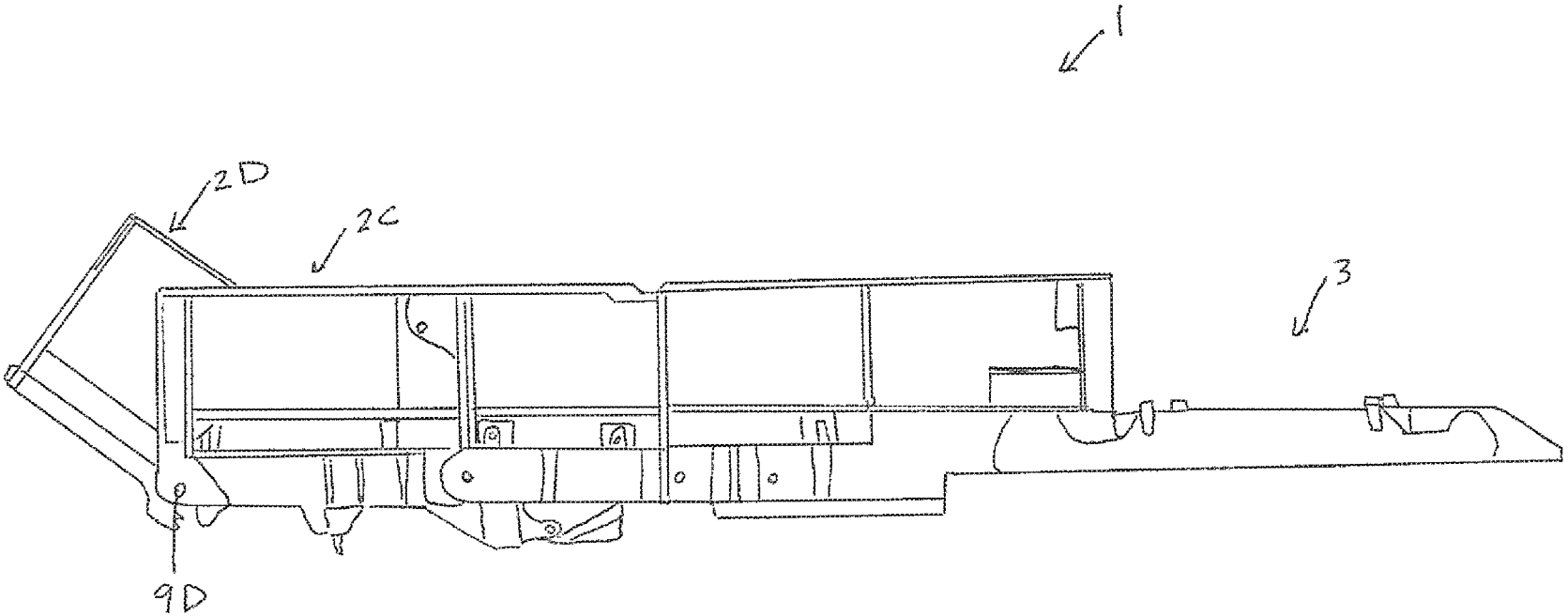
Figure 16:
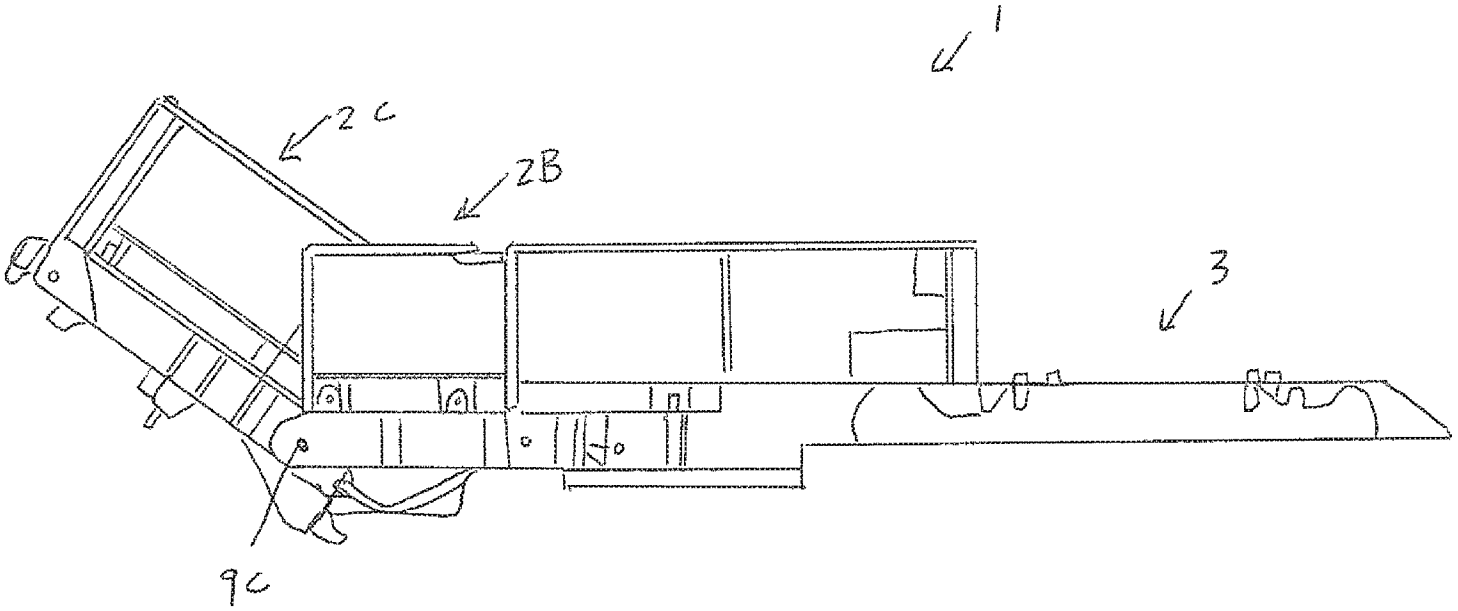
Figure 17:
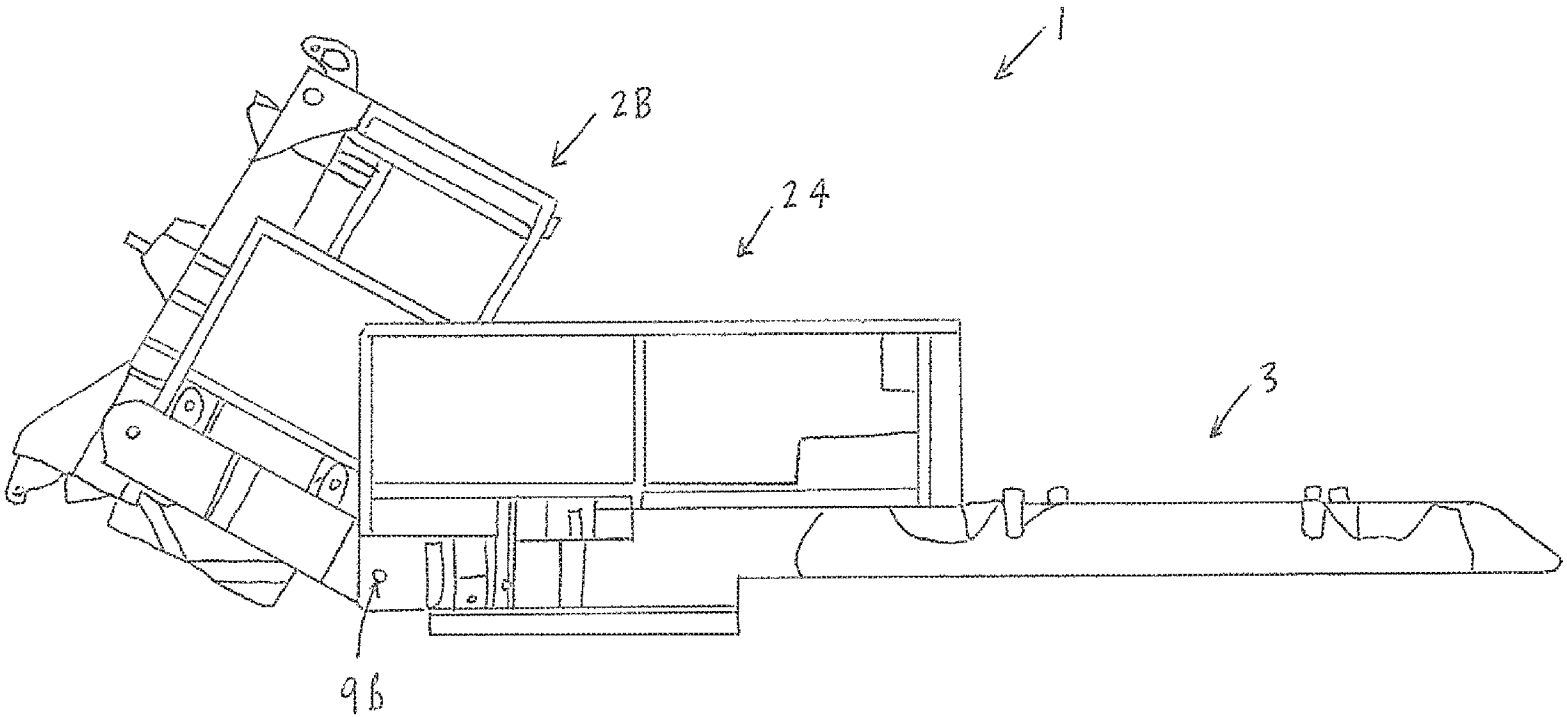
Figure 18:
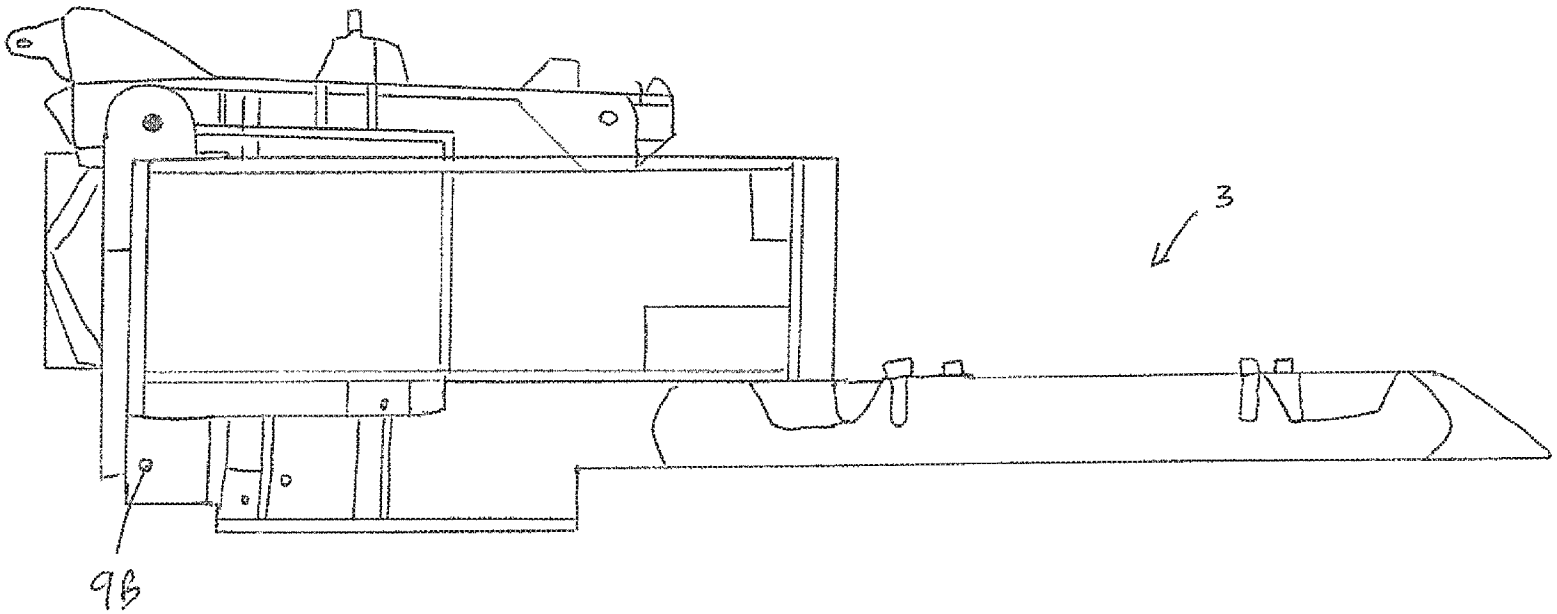
Figure 19:
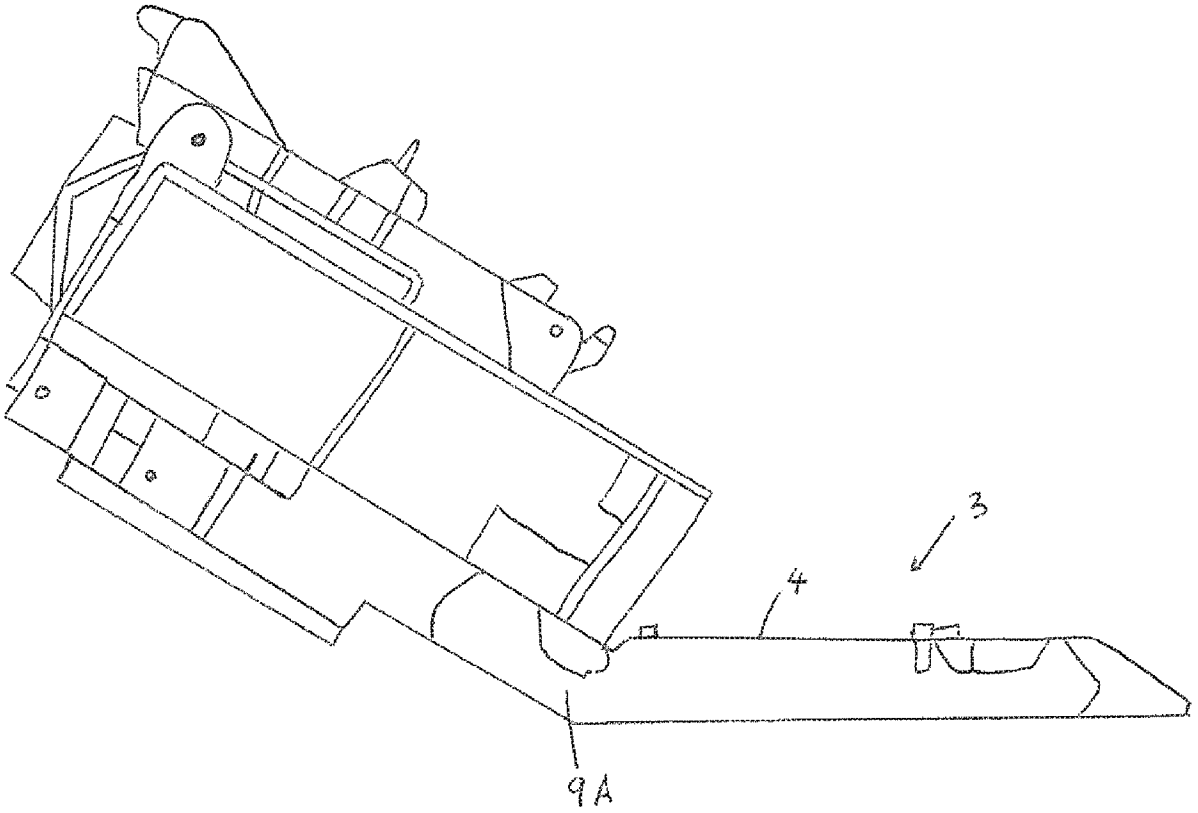

However, turning to FIG. 13, in embodiments, a further pivot point 9A is provided between the cantilever support base 3 and the first stage 2A such that the first stage 2A is itself able to rotate with respect to the support base 3. As alluded to above, and making specific reference to FIG. 2, in embodiments, the pivot 9*a* may be configured such that, when rotated to the full extent with respect to the support base 3, the first stage 2A is substantially 45° with respect to the support base 3.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

COMPRISING AND INCLUDING

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

SCOPE OF INVENTION

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the crane loading industries.

The invention claimed is:

1. A furling crane loading platform comprising:

a cantilever support base;

a first stage pivotally coupled to the cantilever support base; and a second stage pivotally coupled to first stage opposite the cantilever support base and wherein the platform is configurable in:

an unfurled configuration wherein, in use, the first and second stages provide a substantially horizontal crane loading surface extending from a building edge and wherein, in use, when transitioning to the unfurled configuration with the cantilever support base affixed at the building edge, the first stage pivots with respect to the cantilever support base in a first rotational direction and wherein the second stage further pivots with respect to the first stage in the first rotational direction; and a furled configuration wherein, when transitioning to the furled configuration with the cantilever support base affixed at the building edge, the second stage pivots with respect to the first stage in a second rotational direction opposite to the first rotational direction, and wherein the first stage further pivots with respect to the cantilever support base in the second rotational direction, wherein the cantilever support base comprises a downward transition for location beyond the building edge and wherein the stages are connected to the downward transition such that the crane loading surface is substantially level with a surface of a floor slab.

2. A platform as claimed in claim 1, wherein, in the furled configuration, the first and second stages are substantially orthogonal with respect to each other.

3. A platform as claimed in claim 1, wherein, in the furled configuration, the first stage is approximately 45° with respect to the cantilever support base.

4. A platform as claimed in claim 1, wherein, in use, the platform is configured such that, in the furled configuration, at least a portion of the furled stages are within the building edge.

5. A platform as claimed in claim 1, further comprising a third stage pivotally coupled to the second stage.

6. A platform as claimed in claim 5, further comprising a fourth stage pivotally coupled to the third stage.

7. A platform as claimed in claim 6, wherein, in the furled configuration, the stages assume a substantially rectangular configuration.

8. A platform as claimed in claim 1, further comprising actuators for acting on the stages.

9. A platform as claimed in claim 8, wherein the actuators comprise hydraulic actuators.

10. A platform as claimed in claim 8, further comprising a controller for controlling the actuators.

11. A platform as claimed in claim 10, wherein the controller is configured for controlling the stages in a sequence.

12. A platform as claimed in claim 11, wherein the sequence comprises a furling sequence wherein the controller controls the second stage to pivot with respect to the first stage in the second rotational direction whereafter the controller controls the first stage to pivot with respect to the cantilever support base in the second rotational direction.

13. A platform as claimed in claim 10, wherein the controller pivots the second stage until such time that the second stage is substantially orthogonal with respect to the first stage.

14. A platform as claimed in claim 13, wherein the sequence comprises an unfurling sequence wherein the controller controls the first stage to pivot with respect to the cantilever support base in the first rotational direction whereafter the controller controls the second stage to pivot with respect to the first stage in the second rotational direction.

15. A platform as claimed in claim 10, wherein the controller is configured for sensing the configuration of the stages.

16. A platform as claimed in claim 15, further comprising at least one sensor operably coupled to the controller.

17. A platform as claimed in claim 16, wherein the at least one sensor comprises at least one of rotational sensing and position limit switch sensors.

18. A platform as claimed in claim 1, wherein the cantilever support base comprises parallel cantilever support beams.

19. A platform as claimed in claim 18, further comprising support props to prop the cantilever support beams against an undersurface of a floor slab above.

20. A platform as claimed in claim 18, further comprising transverse braces between the cantilever support beams.

21. A platform as claimed in claim 20, wherein the transverse braces are removable from the cantilever support beams.

22. A platform as claimed in claim 18, wherein the cantilever support beams are detachable.

23. A platform as claimed in claim 1, wherein the downward transitioning portion comprises support bases and wherein the first stage comprises laterally projecting feet and wherein, in the unfurled configuration, the feet are supported by the support base.

24. A platform as claimed in claim 1, further comprising crane lift lugs.

25. A platform as claimed in claim 24, further comprising two pairs of laterally adjacent and opposite crane lift lugs to support the platform both longitudinally and laterally during lifting in use.

26. A platform as claimed in claim 1, further comprising a pivot between the first and second stages and further comprising abutments adjacent the pivot and wherein, the abutments abut against each other in the unfurled configuration.

27. A platform as claimed in claim 1, further comprising lockout mechanisms to lock the platform in the unfurled configuration.

28. A platform as claimed in claim 1, wherein the first and second stages each comprise lateral barrier panels and wherein the barrier panels of each respective lateral side of the first and second stages are laterally offset to allow the adjacent barrier panels to slide past each other as the first stage pivots with respect to the second stage.

29. A furling crane loading platform comprising:

a cantilever support base;

a first stage pivotally coupled to the cantilever support base; and a second stage pivotally coupled to first stage opposite the cantilever support base and wherein the platform is configurable in:

an unfurled configuration wherein, in use, the first and second stages provide a substantially horizontal crane loading surface extending from a building edge and wherein, in use, when transitioning to the unfurled configuration with the cantilever support base affixed at the building edge, the first stage pivots with respect to the cantilever support base in a first rotational direction and wherein the second stage further pivots with respect to the first stage in the first rotational direction;

a furled configuration wherein, when transitioning to the furled configuration with the cantilever support base affixed at the building edge, the second stage pivots with respect to the first stage in a second rotational direction opposite to the first rotational direction, and wherein the first stage further pivots with respect to the cantilever support base in the second rotational direction;

actuators for acting on the first and second stages; and a controller for controlling the actuators, wherein the controller is configured for sensing the configuration of the first and second stages.

* * * * *